US005581826A

United States Patent [19]

Edwards

[11] Patent Number: 5,581,826

[45] Date of Patent: Dec. 10, 1996

[54] SWIMMING POOL SKIMMER WITH FLOW SHIFT VALVE FOR POOL CLEANERS

[75] Inventor: Kevin C. Edwards, Canyon Country, Calif.

[73] Assignee: Philip L. Leslie, Tarzana, Calif.

[21] Appl. No.: 414,212

[22] Filed: Mar. 31, 1995

[51] Int. Cl.[6] ..... E04H 4/00

[52] U.S. Cl. ..... 4/507; 137/624.14

[58] Field of Search ..... 4/490, 496, 507–510; 137/624.14; 210/169

[56] References Cited

U.S. PATENT DOCUMENTS 4,643,217 2/1987 Frentzel ..... 137/624.14 X
4,776,953 10/1988 Frentzel ..... 210/169

*Primary Examiner*—Charles E. Phillips
*Attorney, Agent, or Firm*—Philip D. Junkins

[57] ABSTRACT

An automatic flow shift valve for use with swimming pool cleaning systems including a pool skimmer system for removing floating debris from the surface of the pool and an underwater pool cleaner system for removing debris from the floor of the pool, both of such systems operating through water suction by the periodic "on" and "off" cyclic operation of a suction pump. The valve is mounted over a flow orifice in a cover plate which is removably secured across the top of the well and removable debris basket of the skimmer and the underwater pool cleaner is connected by a hose to a second opening in the cover plate. The valve includes a central, fixed-position shift cylinder enclosing upper and lower spaced, but interconnected, pistons which are reciprocative within the shift cylinder. The upper piston is spring biased upwardly to open the valve when the pump is "off". The lower piston bears an orifice closure plate for closing off water flow through the skimmer and the flow orifice of the cover plate based upon water suction force on the closure plate during one cycle when the pump is "on", thereby causing suction operation of the underwater pool. A control cam located between the upper and lower pistons is operable to lock the pistons in an intermediate upper position within the shift cylinder to maintain the valve open during a second cycle when the pump is "on", thereby causing suction operation of the skimmer.

11 Claims, 2 Drawing Sheets

FIG. 1.
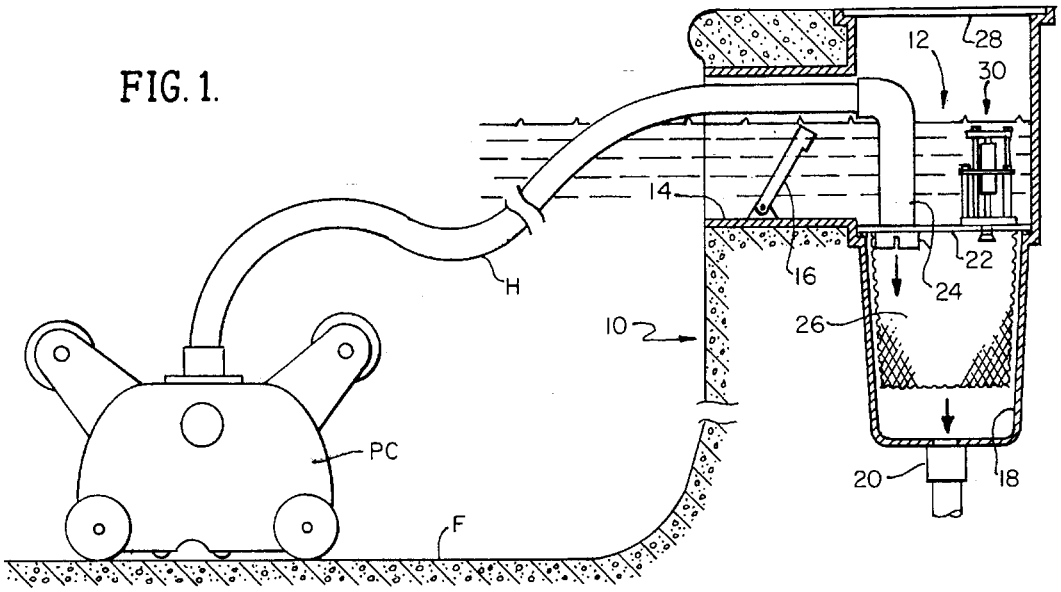
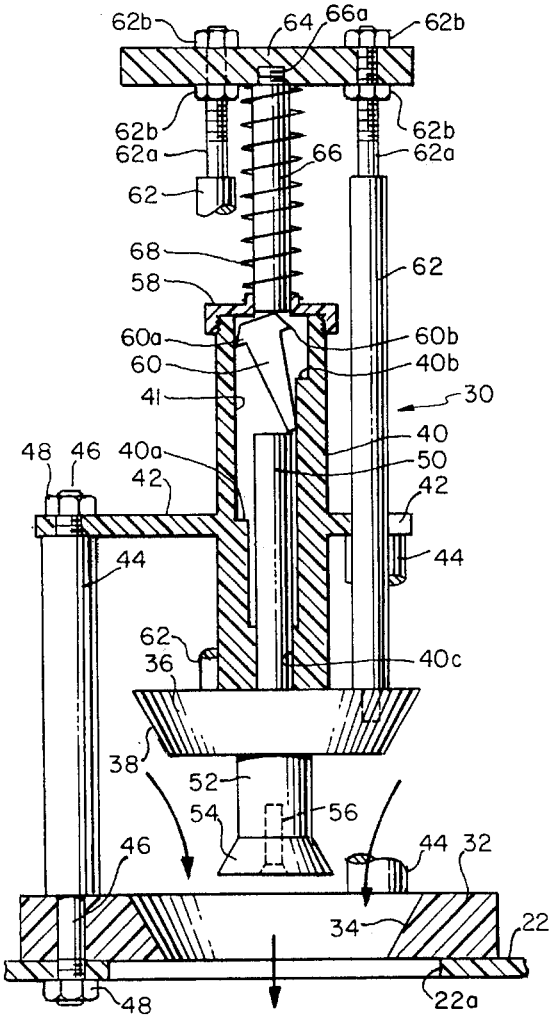
FIG. 3.
FIG. 2.
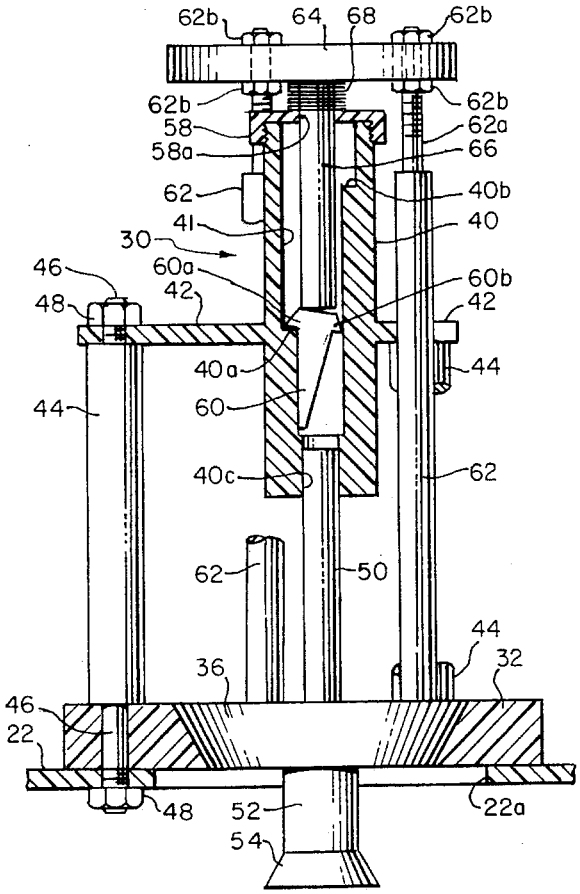

SWIMMING POOL SKIMMER WITH FLOW SHIFT VALVE FOR POOL CLEANERS

FIELD OF THE INVENTION

The present invention relates to swimming pool cleaning systems. More particularly, the invention relates to swimming pool cleaning systems which include a skimmer system for removing debris from the upper surface of a swimming pool and an underwater suction-operated pool cleaner for removing debris from the floor of the pool.

BACKGROUND OF THE INVENTION

For many years attention has been directed to the development and manufacture of systems for cleaning swimming pools. Thus, for public swimming pools and for most of the larger private swimming pools, particularly of below ground construction, a built-in water recirculation system is provided for filtering the water. Such recirculation systems usually include a water surface skimmer which is in communication with a suction pump at the filter station. The suction pump draws off water from the pool through the skimmer, draws the water through the filter station, and returns filtered water to the pool through a pressurized outlet. While the water is out of the pool it can also be heated.

Surface skimmers typically have an opening or inlet channel at the pool water level. The suction pump, through its water recirculation action, draws surface debris into a perforated basket within the well of the skimmer. Surface skimmer systems, in and of themselves, cannot remove debris which has settled to the bottom of the pool. Thus, pool owners and pool maintenance operators in the past have had to vacuum the bottom of the pool with an underwater suction cleaner directly connected by a flexible hose to the filter and pump station associated with the pool. In recent years skimmer systems have also included a cover plate for the skimmer well which includes means to interconnect the system to an underwater suction-operated pool cleaner and means which allows the system to alternately provide water surface debris skimming action and underwater pool cleaning action.

Underwater suction-operated pool cleaners, connected by suction hose means to the skimmer as a water suction source, operate by the suction of water drawn through the device thereby powering an internal turbine which enables the device to move about the pool floor while vacuuming the pool floor by the suction action of the cleaner. Debris that has settled to the pool floor is sucked into the device and passed out through the suction hose. In the past, underwater suction-operated pool cleaning devices, utilizing the skimmer system as the suction source, required an upstream debris collector or trap installed for catching the floor bottom debris carried by the hose before it reached the skimmer. This was necessitated because the suction hose of the underwater device had to be alternately connected to and unconnected from the suction inlet at the bottom of the skimmer well for operation of the device with removal of the debris basket otherwise required in the well for normal skimmer action.

Although underwater suction-operated pool cleaners have provided a very effective means for cleaning the floor of swimming pools and even the walls thereof, as indicated above, initial use of such cleaners via suction connection through pool skimmers necessitated manual hose connection directly to the suction inlet at the bottom of the skimmer well below the debris basket. Thus, the skimmer had to be inactivated while the cleaner was in operation with the result that during floor cleaning of the pool floating debris at the pool surface was not collected.

In most swimming pool operations the skimmer is not operated in a continuous fashion, i.e., the suction pump at the external filter-pump station draws water through the skimmer on a time controlled basis. Thus, most pool filtration systems operate on timers which cycle suction pump operation between "on" and "off" periods that may last for between 10 and 20 minutes during the twenty-four hour day. Further, underwater suction-operated pool floor cleaners are not operated on a continuous basis with pool floor cleaning being conducted over "on" and "off" cycle periods that also may last 2 to 8 or more hours.

To overcome the requirement that the pool owner or pool maintenance operator alternate the path of suction water between the pool skimmer and an underwater pool cleaner via the suction pump, there has been disclosed in U.S. Pat. No. 4,643,217, granted to H. E. Frentzel, an indexable valve which fits into the suction inlet of the skimmer. Such valve receives the suction hose connected to the underwater pool cleaner. In a first operating position the valve allows water to be drawn through the suction hose of the cleaner directly into the suction inlet of the skimmer. In its second operating position, water is passed through the valve directly from the skimmer. The valve of the Frentzel patented device indexes through an intermediate position whenever the suction pump is inactivated.

Frentzel, in his subsequent U.S. Pat. No. 4,776,953, indicated that the foregoing described indexable valve operated quite well with existing time controlled suction pump and filter systems. Thus, the indexable valve was designed such that every time the filtration system is turned off, the valve would shift through its intermediary position, to one of either the first or second positions. In this manner, the pool would alternately be skimmed or vacuumed automatically, throughout the day, without any intervention from the pool owner or maintenance operator. The earlier Frentzel patented system required an intermediary debris trap mounted upstream from the suction inlet of the skimmer to collect the debris before it passes into the skimmer. Frentzel found that the upstream debris trap was not desirable since such traps are difficult to clean and the pool owners and maintenance operators were accustomed to servicing a standard skimmer debris basket.

In his U.S. Pat. No. 4,776,953 Frentzel proposed that a cover plate be installed across the top of the skimmer well to seal off the upper surface of the well. Pipe means was provided in the skimmer to connect the suction hose from the underwater pool cleaner to an orifice in the plate so that water and debris from the pool cleaner could be suction through the well and its enclosed debris basket. The skimmer cover plate further included an automatic indexable valve positioned over a second orifice in the plate and movable between two primary positions. In a first primary position, the water flow is restricted through the valve so that the suction generated in the well by the suction pump is diverted to draw water through the cleaner hose connected to the underwater pool cleaner. When the valve is in its second primary position, surface water and debris are drawn directly through the valve and into the skimmer well. In both primary valve operating positions, water passing through either the cleaner hose or the valve is strained through the debris basket within the well. The Frentzel valve not only indexes (reciprocates) between upper and lower primary positions, its central piston rotationally indexes whereby the valve is caused to reciprocate to an intermediate position whereby water and debris is drawn into the skimmer well and debris basket through the skimmer as-well-as from the underwater pool cleaner.

As described above, the second Frentzel patent discloses an improved pool water cleaning system, with respect to prior art systems, which includes an indexable valve for alternately directing suction water either drawn through an underwater pool cleaner hose or drawn through the channel leading from the pool to the skimmer well and through the debris basket therein. However, the Frentzel indexable valve is complex in structure and has encountered problems in operation. For example, the central piston and its conically shaped sealing element which in its lowest position seals off the skimmer plate valve orifice (leading from the upper water inlet section of the skimmer to the skimmer well) is supported and reciprocates on a central rod which is threaded to a support member located below the valve orifice, The support member includes a number of struts that are in the flow path of the surface water and leaves that are drawn into the debris basket by the suction pump with the leaves and other pool debris frequently hanging up on such struts and impeding flow into the basket. Further, the central piston and sealing element are biased upwardly by a spring surrounds the central support rod. Because the valve's central piston indexes (reciprocates) upwardly and downwardly and rotates (in indexing fashion) during operation of the valve, the spring frequently becomes twisted and resists further rotation of the central piston thereby requiring replacement.

Accordingly, it is a principal object of the present invention to provide a new and improved flow shift valve which may be used in conjunction with a pool skimmer and an underwater pool cleaner.

It is another object of the invention to provide a new and improved flow shift valve system which allows an underwater suction-operated pool cleaner to be operated in conjunction with swimming pool surface water skimmer systems of common design and operation.

It is still a further object of the invention to provide a skimmer cover plate which is mountable to the top of a pool skimmer well and which includes thereon an improved flow shift valve of unique construction for directing the alternate operation between an underwater suction-operated pool cleaner and the pool skimmer system.

Other objects and advantages of the invention will be apparent from the following summary and detailed descriptions of the unique flow shift valve of the invention taken together with the accompanying drawing figures.

SUMMARY OF THE INVENTION

The present invention relates to swimming pools having a suction skimmer system. Pool skimmer systems commonly include a well with a suction inlet at the bottom of the well and an enclosed removable perforated debris collection basket for receiving leaves and other debris matter that float on the surface of the pool. The suction inlet is interconnected to a water suction pump at a remote pump and filter station which returns filtered pool water to the pool under pressure. The upper surface of the well is below the water level of the pool. The pool owner or pool maintenance operator periodically empties the debris basket.

The present invention utilizes a unique flow shift valve mounted over a first orifice in a skimmer cover plate which is removably mounted across the top of the skimmer well. The flow shift valve permits the alternate and distinct operation of the skimmer and an underwater suction-operated pool cleaner. The pool cleaner, through its flexible suction hose, is interconnected through the skimmer inlet channel to an upstanding pipe section affixed to the skimmer cover plate at a second orifice so that the pool cleaner is provided with a source of water suction power.

The flow shift valve includes a fixed-position central cylinder supported by mounting posts at a spaced distance above a valve mounting plate which is affixed to the skimmer cover plate over the first orifice of such plate. The valve mounting plate includes a conical flow orifice which is aligned with the first orifice of the skimmer cover plate. Positioned within the lower portion of the central cylinder is a first piston which is reciprocable within the cylinder and bears at its lower end portion a conical orifice closure plate for periodically closing the mating conical flow orifice of the valve mounting plate during cyclic operation of the flow shift valve. Positioned within the upper portion of the central cylinder is a second piston with a top plate. Such top plate is interconnected by an annular arrangement of posts to the orifice closure plate whereby the second (upper) piston is reciprocable within the central cylinder with the first (lower) piston at a fixed spaced distance therefrom. Encircling the second (upper) piston is a coil spring which extends between the top plate of the second piston tube and the top of the fixed-position central cylinder of the valve arrangement and biases the interconnected piston set upwardly within and with respect to the central cylinder.

Located within the central cylinder, in the valve control space between the upper end of the lower piston and the lower end of the upper piston, is a flip-flop cam having opposing cam-head catch projections. The central cylinder of the flow shift valve arrangement has catch ledges proximate the upper end of the cylinder and the intermediate portion thereof. During the cyclic operation of the suction pump, interconnected to the skimmer well, the pistons within the central cylinder reciprocate together upwardly and downwardly therein in response to the upward biasing action of the coil spring and the downward suction action of water through the flow orifice below the valve arrangement in the skimmer cover plate. Thus, in operation of the skimmer flow shift valve arrangement of the invention the sequence of valve positions is as follows:

1. With first initiation of the suction pump the piston set of the valve is moved downwardly via water suction action on the valve closure plate with such plate closing off water flow through the flow orifice of valve thereby prohibiting any skimming action via the skimmer system (see FIG. 2). With the skimmer system inactive the suction pump draws water and debris from the underwater pool cleaner via the cleaner hose interconnected to the skimmer cover plate. The flip-flop cam within the central cylinder of the valve arrangement assumes a position near the lower end of such cylinder with one of its cam-head catch projections impinging on the lower catch ledge within the cylinder.
2. After an appropriate suction pump running period, and operation of the underwater pool cleaner, the cycle timer at the pump-filter station terminates operation of the pump. With the cessation of water suction through the skimmer well the valve closure plate is released from its position closing off the flow orifice of the flow shift valve and the piston set is pushed upwardly by the biasing action of the coil spring to its uppermost position (see FIG. 3). The piston set is stopped in its upward movement by the flip-flop cam through its cam-head abutment with the upper end closure member of the central cylinder.

3. After an appropriate pump rest period the cycle timer at the pump-filter station re-initiates operation of the suction pump. Water suction action on the valve closure plate via the open flow orifice of the flow shift valve draws the closure plate (and piston set) downwardly against the biasing action of the coil spring. The closure plate and piston set is precluded from full movement to the flow orifice closure position by the flip-flop cam with one of its cam-head catch projections impinging on the upper catch ledge within the central cylinder during in its own downward movement (see FIG. 4). While the pump runs during this cycle water is drawn through the substantially open flow orifice of the valve thereby effecting skimming action by the skimmer system.
4. After an appropriate suction pump running period, and skimming action by the pool skimmer, the cycle timer at the pump-filter station again terminates operation of the pump. With the cessation of water suction through the flow orifice of the flow shift valve and the skimmer well the valve closure plate is released form its pull toward the flow orifice of the valve by water suction and the piston set is pushed upwardly by the biasing action of the coil spring to its uppermost position (see again FIG. 3).
5. After another appropriate pump rest period the cycle timer re-initiates operation of the suction pump and the cycles 1 though 4 above are repeated in sequence.

It is to be understood that the annular arrangement of posts interconnecting the top plate of the central cylinder of the valve and the lower orifice closure plate are adjustable in their length whereby the the distance between the bottom of the upper piston and the upper end of the lower piston may be increased or decreased. Thus, where it is desired that there be provided some clearance space between the conical orifice closure plate and the mating conical flow orifice of the valve mounting plate to assure that there can be no complete stopage of water suction flow during operation of the suction pump, the distance between such pistons may be shortened so that the flip-flop cam precludes the orifice closure plate from complete closure of the flow orifice of the valve. Other features and advantages of the flow shift valve of the present invention will become apparent from the detailed description thereof.

BRIEF DESCRIPTION OF THE DRAWING FIGURES

FIG. 1 is a side elevation view, partially in section, of a swimming pool showing an underwater suction-operated pool cleaner connected to a pool skimmer having a well and debris basket enclosed by an upper skimmer cover plate and showing the flow shift valve of the present invention mounted on the cover plate.

FIG. 2 is a side elevation view of the flow shift valve of the invention mounted to the skimmer cover plate, partially in section, with the valve closure plate in its lower mating position with the valve orifice plate thereby closing off suction flow of the pool's surface water and surface debris into and through the debris basket and skimmer well and providing full water suction flow through the skimmer well from the underwater suction-operated pool cleaner.

FIG. 3 is a side elevation view of the flow shift valve of FIG. 2, partially in section, with the valve closure plate in its upper position with respect to the valve orifice plate thereby fully opening the flow orifice and permitting full suction flow of the pool's surface water and surface debris into and through the debris basket and skimmer well with no water suction flow through the skimmer well from the pool cleaner.

FIG. 4 is a side elevation view of the flow shift valve of FIG. 2, partially in section, with the valve closure plate in an intermediate position with respect to the valve orifice plate thereby partially restricting suction flow of the pool's surface water and surface debris into and through the debris basket and skimmer well while permitting limited water suction flow through the skimmer well from the underwater suction-operated pool cleaner.

DETAILED DESCRIPTION OF THE PREFERRED EMBODIMENT

Figure 5:
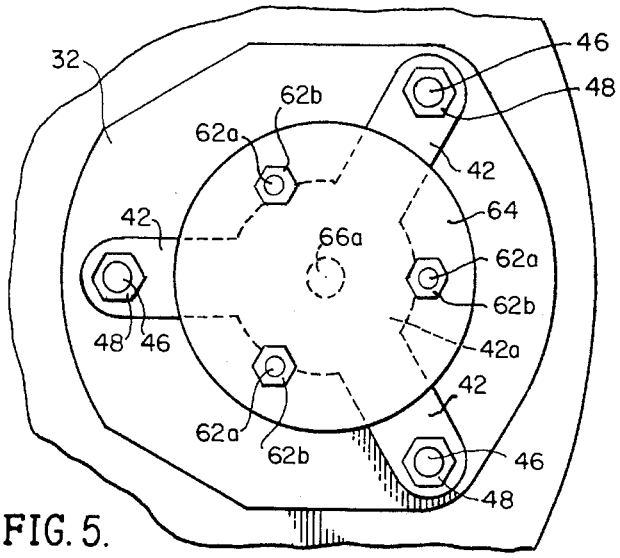
FIG. 5 is a top view of the flow shift valve of FIG. 2 of the invention.

Referring initially to FIG. 1, there is illustrated a typical swimming pool structure 10 having a skimmer system for removing floating debris from the upper surface of the pool. The skimmer 12 of the skimmer system is built into the side of the pool 10 and is provided with a channel 14 which comprises a fluid path from the swimming pool to the skimmer and its debris collection well. A weir 16 is pivotally mounted in channel 14 to improve the effectiveness of the surface skimming action by preventing floating debris, captured by the skimmer, from returning to the pool. The debris collection well 18 of skimmer 12 has at its bottom a water suction inlet 20 which is connected to a suction pump (not shown) for drawing water from the pool through the channel 14 and into the skimmer system and the well.

In accordance with the present invention the skimmer system is provided with a removable inner cover plate 22 which includes an opening within which is mounted a pipe section 24 for connection, via a flexible hose H, to an underwater suction-operated pool cleaner PC. The cover plate 22 is supported at its peripheral rim by the upper edge portion of the debris collection well 18. Also supported by the upper edge portion of the well 18, and depending into the well therefrom, is a perforated debris basket 26 for catching and containing leaves and other floating debris which pass through the skimmer system into the basket through an opening **22*a* in the cover plate 22 (see FIGS. 2, 3 and 4). A removable skimmer lid 28 is provided at the top of the skimmer 12 to permit the pool owner or maintenance operator to periodically open the skimmer system, lift the inner cover plate 22, and reach into and empty the debris basket of the collected debris. With respect to the operation of the skimmer system, the water at the upper surface of the pool is drawn into the skimmer 12 over the weir 16 and is filtered through the perforated debris basket 26**.

As indicated hereinbefore, even in pools having a surface water skimming system, it is usually necessary for the pool owner or maintenance operator to vacuum the bottom of the pool. A wide variety of suction-operated underwater pool cleaners are now available which are powered by the water flow suction of the pool skimmer thereby providing automatic and regular vacuuming of the floor of the pool in response to the operation of the vacuum pump interconnected to the skimmer system of the pool. Included in FIG. 1 is an illustration of the outer configuration of one such underwater pool cleaning device PC which is the subject of U.S. Pat. No. 5,197,158 granted to S. Moini. In operation of the pool cleaner PC, water suction is applied to the cleaner through suction hose H, Water drawn through the device provides the power that enables the device to move about the pool floor F collecting debris that has settled thereon. The pool floor debris is drawn up through the hose H and into the pool skimmer system for deposit in the debris collection basket. Also included in FIG. 1 is an illustration of the respective size and placement of the unique flow shift valve 30 of the invention which is mounted on the inner skimmer well cover plate 22.

Figure 4:
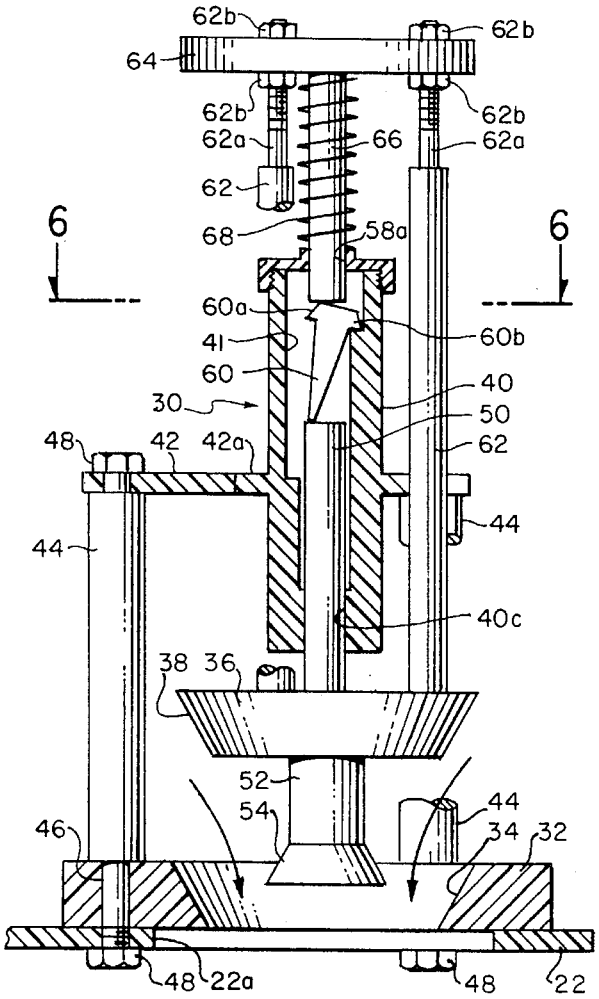

As shown in FIGS. 2, 3 and 4, the flow shift valve of the invention includes a valve mounting plate (or orifice plate) 32 having a central conical flow orifice 34. The valve mounting plate 32, which may be formed of a molded rigid plastic material) is appropriately affixed to the skimmer well cover plate 22 with the flow orifice 34 located in central alignment with a first orifice (or water suction opening) 22*a* of such cover plate. The flow shift valve 30 per se is comprised of a lower conical orifice closure plate 36 and associated lower and upper pistons (molded plastic cylinders or hollow metallic tubes) and connecting posts as described hereinafter, all of such components moving together during operation of the valve. The orifice closure plate 36 (molded of a rigid plastic material) has a conical interface surface 38 which mates with the surface of the central conical flow orifice 34 of the mounting plate 32 when the valve is closed.

The movable components of the flow shift valve 30 are supported by a central shift cylinder 40 which includes an internal piston and cam channel 41. The shift cylinder 40, molded of a rigid plastic material, is supported by three integral shift cylinder mounting flanges 42 which extend radially from a central ring portion 42*a* of the molding. The internal piston-cam channel 41 of the shift cylinder 40 has a generally oval cross-section (see FIG. 6) and includes cam catch ledges 40*a* and 40*b*, the function of which will be described hereinafter. The shift cylinder 40 also includes a reduced diameter section 40*c* at the lower end of the cylinder through which a first (lower) piston 50 slides in reciprocating fashion during operation of the valve 30.

Figure 6:
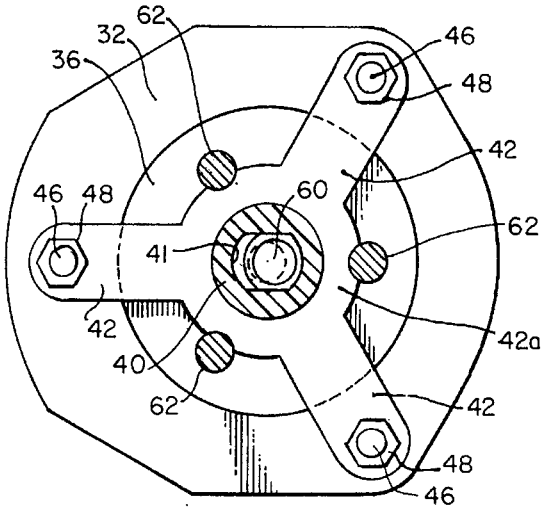
FIG. 6 is a cross-sectional view of the flow shift valve of FIG. 4 taken along line 6—6 of FIG. 4.

The radially extending mounting flanges 42 of the molded shift cylinder 40 are supported at their respective outer end portions on cylindrical mounting posts 44. The mounting posts 44 are affixed to the skimmer cover plate 22 and valve mounting plate 32 via post bolts 46 (threaded at their ends) which extend through the cover plate, mounting plate, mounting posts and mounting flanges and are maintained in their shift cylinder supporting arrangement via threaded retaining nuts 48. The arrangement of the three mounting flanges 42 of the shift cylinder 40 and the post bolts 46 for retaining the shift cylinder in its fixed position over the mounting plate 32 is shown in FIGS. 5 and 6.

Positioned within the lower portion of the central shift cylinder 40 is a first (lower) piston 50. The piston 50 reciprocates within the shift cylinder 40 and may comprise an integrally molded portion of the conical orifice closure plate 36 which periodically closes the mating conical flow orifice 34 of the valve mounting plate 32 during cyclic operation of the flow shift valve 30. The piston 50 is maintained in its appropriate sliding alignment within the shift cylinder 40 via the reduced diameter section 40*c* at the lower end of such cylinder. Depending from the underside of the orifice closure plate 36 is a post 52 (may be an integrally molded portion of the closure plate) which bears a flow deflector 54 (held to the post 52 via a machine screw 56).

The upper end of the central shift cylinder 40 is threaded and such cylinder is closed by a cap 58 which is threaded onto the cylinder. The cap 58 includes a circular central opening 58*a*. Positioned within the upper portion of the fixed-position central cylinder 40 is a second (upper) piston 66 which is affixed, via a threaded upper connection portion 66*a*, to a top plate 64. The piston 66, which passes through and is aligned via the central opening 58*a* of cap 58, reciprocates within the shift cylinder 40. The piston 66 is maintained in its upper reciprocating position within the shift cylinder 40 via annularly spaced connector posts 62 which extend upwardly from the top surface of the conical orifice closure plate 36 to the top plate 64 of the upper piston 66. The posts 62 bear threads at each end with the lower end of each post 62 threaded into the closure plate 36. The upper threaded ends 62*a* of these posts pass through the top plate 64 and the positioning of the top plate with respect to the shift cylinder 40 (and correspondingly the spacing of the top plate and its depending piston 66 with respect to the lower piston 50) is adjustable by the relative placement of the lock nuts 62*b* which are threaded onto the posts 62 on each side of the top plate. The foregoing movable assembly of closure plate 36, lower piston 50, connector posts 62, top plate 64 and upper piston 66 results in a flow shift valve arrangement wherein the lower and upper pistons reciprocate together within the fixed-position central cylinder 40 at a fixed space distance from one-another.

Encircling the second (upper) piston 66 is a coil spring 68 which extends between the top plate 64 and the top of the cap 58 which encloses the upper end of the fixed-position central cylinder 40 of the flow shift valve 30. The spring 68 biases the interconnected piston set 50-66 upwardly within and with respect to the central cylinder 40.

FIG. 5 is a top view of the flow shift valve 30 of FIG. 2 showing particularly the top plate 64 and the mounting flanges 42 of the central shift cylinder 40 to illustrate the bolting arrangement of such plate and flanges-with respect to their supporting posts. FIG. 6 is a cross-sectional view of the flow shift valve 30 of FIG. 4 taken along line 6-6 of FIG. 4 showing particularly the arrangement of posts 62 which support the top plate 64, the mounting flanges 42 which extend radially from the central shift cylinder 40 and the bolting arrangement of flanges with respect to their supporting posts. FIG. 6 also shows the oval configuration of the cam channel 41 within cylinder 40.

Figure 7:
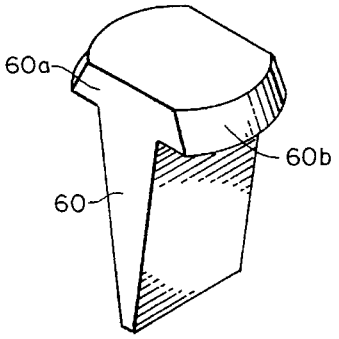
FIG. 7 is a side perspective view of the flip-flop cam which is shown in its three positions in FIGS. 2, 3 and 4 and which establishes the positions of the valve closure plate during the phases of operation of the flow shift valve of the invention.

Located within the central cylinder 40, in the space between the upper end of the lower piston 50 and the lower end of the upper piston 66, is a metallic flip-flop cam 60 of oval configuration which has opposing cam-head catch projections 60*a* and 60*b* (see FIG. 7 for a perspective view of the cam 60). The central cylinder 40 of the shift valve arrangement 30 has a cam catch ledge 40*a* proximate the intermediate portion of the cylinder and a cam catch ledge 40*b* proximate the upper end of the cylinder. During cyclic operation of the water suction pump (interconnected to the swimming pool skimmer well) the pistons 50 and 66 within the central cylinder 40 reciprocate together upwardly and downwardly therein in response to the upward biasing action of the coil spring 68 and downward suction action of water flow through the flow orifice 22*a* (below the valve arrangement) in the skimmer plate 22.

In operation of the skimmer flow shift valve arrangement 30 of the invention, the cycle sequence of valve and flip-flop cam positions is as follows:

1. Cycle Phase I. With first initiation of the swimming pool suction pump (inter-connected to the suction outlet 20 of the pool skimmer 12) the piston set 50-66 of the valve 30 is moved downwardly via water suction action on the valve closure plate 36 thereby closing off water flow through the flow orifice of the valve and prohibiting any skimming action via the skimmer system. With the pool skimmer system inactive the suction pump draws water and debris from the underwater pool cleaner PC via the cleaner hose H interconnected to the skimmer cover plate 22 via pipe section 24 (see particularly FIGS. 1 and 2). The flip-flop cam 60 within the cam channel 41 of the central cylinder 40 of the valve arrangement assumes a position near the lower end of such channel with its cam-head catch projection 60*a* impinging on the lower catch ledge 40*a* of the cylinder.
2. Cycle Phase II. After an appropriate pump running period, and operation of the underwater pool cleaner PC (2–4 or more hours), the cycle timer at the pump-filter station of the swimming pool terminates operation of the suction pump. With the cessation of water suction through the skimmer well the valve closure plate 36 is released from its position closing off the flow orifice 34 of the flow shift valve 30 and the piston set 50-66 is pushed upwardly by the biasing action of the coil spring 68 to its uppermost position (see FIG. 3). The piston set 50-66 is stopped in its upward movement when the upper surface of the closure plate 36 reaches the point whereat it comes in contact with the lower end of the fixed-position central cylinder 40 (see FIG. 3).
3. Cycle Phase III. Following an appropriate pump rest period (perhaps of 1–2 hours or less) the cycle timer at the pump-filter station re-initiates operation of the suction pump. Water suction action on the valve closure plate 36 via the open flow orifice 34 of the flow shift valve 30 draws the closure plate 36 downwardly against the biasing action of the coil spring 68. The closure plate and piston set 50-66 is precluded from full movement downwardly to the flow orifice closure position by the flip-flop cam 60 because cam-head catch projection 60*b* of the flip-flop cam impinges on the upper catch ledge 40*b* within the cam channel 41 of the central cylinder 40 during the downward movement of such cam (see FIG. 4). While the pump runs during this cycle phase (perhaps of 2–4 or more hours duration) water is drawn through the substantially open flow orifice 34 of the valve thereby effecting skimming action by the skimmer system.
4. Cycle Phase IV. After the appropriate suction pump running period (with skimming action by the pool skimmer during phase III), the cycle timer at the pump-filter station terminates operation of the pump. With the cessation of water suction through the flow orifice 34 of the flow shift valve and the skimmer well the valve closure plate 36 is released from its pull toward the flow orifice of the valve by water suction and the piston set 50-66 is again pushed upwardly by the biasing action of the coil spring 68 to its uppermost position (see again FIG. 3).
5. Cycle Phase V. Following another appropriate pump rest period (perhaps of 1–2 hours or less) the cycle timer re-initiates operation of the suction pump and the cycle phases are repeated in sequence.

As indicated hereinbefore, the annular arrangement of posts 62 interconnecting the top plate 64 (and its depending piston 66) of the flow shift valve 30 and the lower closure plate 36 are adjustable in their length by the placement of the lock nuts 62*b* which are threaded onto the upper threaded portion 62*a* of posts 62. Thus, the length of the posts 62 may be decreased where it is desired to provide some clearance space between the conical orifice closure plate 36 and the mating conical flow orifice 34 of the valve mounting plate 32 to assure that there can be no complete stoppage of water suction flow during operation of the suction pump—such a stoppage, if for an extended period of time, perhaps causing burn-out of the pump. The shortening of the length of the posts reduces the distance between the pistons 66 and 50 in the cam channel 41 of the central cylinder 40 so that the flip-flop cam 60 in the position shown in FIG. 2 precludes the orifice closure plate 36 from complete closure of the flow orifice 34 of the valve 30.

While the subject invention has been described with reference to a preferred embodiment thereof, it should be understood that changes of structure and construction materials can be made therein by one skilled in the art without varying from the scope and spirit of the invention as defined by the following claims.

What I claim is:

1. An automatic flow shift valve (30) for restricting the flow of swimming pool water and surface debris through a suction skimmer system including a skimmer well (18) interconnected to a suction pump and having a sealed upper well cover plate (22) provided with a skimmer flow orifice (22*a*) and means (24) for interconnecting said well with an underwater suction-operated pool cleaner, said flow shift valve (30) having a lower valve mounting plate (32) including a circular valve flow orifice (34) having a downwardly and inwardly sloped annular conical surface positioned on said well cover plate in interfacing relationship to said skimmer flow orifice, said flow shift valve comprising:

a) a central shift cylinder (40) having an upper end portion and a lower end portion and mounted in a fixed position above said valve mounting plate (32) and in axial alignment with said circular valve flow orifice (34);

b) a movable circular valve closure plate (36) having a downwardly and inwardly sloped annular conical surface for interfacing with the annular conical surface of said valve flow orifice for periodically closing and opening said valve flow orifice;

c) a first elongated valve control piston (50) having its lower end interconnected to said valve closure plate (36) and its upper end extending upwardly therefrom and into reciprocating relationship within the lower end portion of said shift cylinder (40);

d) a valve top plate (64) interconnected in fixed relationship to the circular valve closure plate (36), said top plate being located above the upper end portion of said shift cylinder (40) and being movable with said closure plate;

e) a second elongated valve control piston (66) having its upper end interconnected to said valve top plate (64) and its lower end extending downwardly therefrom and into reciprocating relationship within the upper end portion of said shift cylinder (40), the upper end of said first piston (50) and the lower end of said second piston (66) being spaced from one-another and defining a valve control space within said shift cylinder (40) between said pistons;

f) biasing means (68) located between said top plate (64) and the upper end portion of said shift cylinder (40) for urging said top plate and the interconnected valve closure plate (36) upwardly whereby said closure plate is separated from said valve flow orifice (34) and said flow shift valve (30) is fully open when said suction pump is at rest and no water suction force is applied to the underside of said closure plate (36) to pull it downwardly toward said valve flow orifice in opposition to said biasing means, the upward movement of said valve closure plate (36) being limited by the interface contact of said closure plate with the lower end portion of said shift cylinder;

g) a cam (60) and first stop means (4O*b*) within the central shift cylinder (40) limiting the downward reciprocation of the second valve control piston (66) to an intermediate open valve position during operation of said suction pump with the application of water suction force to the underside of the valve closure plate (36) in opposition to said biasing means (68) whereby the water suction force of said pump draws water and surface debris through the skimmer and valve flow orifice (34) into the skimmer well (18); and h) second stop means (40*a*) for said cam (60) within the central shift cylinder (40) for limiting the downward reciprocation of the second valve control piston (66) to a lowermost position during the operation of said suction pump with the application of water suction force to the underside of the valve closure plate (36) in opposition to said biasing means (68) whereby said closure plate (36) closes said flow orifice (34) and the water suction force of said pump draws water and pool floor debris from said underwater pool cleaner into said skimmer well.

2. The automatic flow shift valve as claimed in claim 1 wherein the biasing means located between the valve top plate and the upper end of the central shift cylinder is a coil spring which surrounds the second valve control piston interconnected to said top plate.

3. The automatic flow shift valve as claimed in claim 1 wherein the central shift cylinder of said valve mounted in a fixed position above the valve mounting plate includes radially extending mounting flanges each supported on a mounting post which extends upwardly from said mounting plate.

4. The automatic flow shift valve as claimed in claim 1 wherein the top plate of said valve is interconnected in fixed relationship to the valve closure plate by annularly spaced mounting posts positioned outside of the central shift cylinder, said mounting posts being adjustable in their length to provide appropriate spaced-apart positioning of the first and second valve control pistons within said shift cylinder.

5. The automatic flow shift valve as claimed in claim 1 wherein the cam within the central shift cylinder is of wedge shape with two opposing cam-head catch projections and is movable upwardly and downwardly in an oval shaped cam channel in said shift cylinder within the valve control space defined between the upper end of the first valve control piston and the lower end of the second control valve piston and wherein the first stop means within said shift cylinder comprises an upper cam catch ledge on one side of said cam channel for interacting with the cam-head catch projection on one side of said cam and the second stop means within said shift cylinder comprises an intermediate cam catch ledge on the opposite side of said cam channel for interacting with the cam-head catch projection on the opposite side of said cam.

6. In combination with a suction skimmer system of a swimming pool, said skimmer system including: a skimmer well (18) with its upper surface sealed by a removable well cover plate (22), a suction inlet at the bottom of said well connected to a suction pump operated periodically by a cycle timer, a perforated basket (26) removably positioned within said well below the cover plate for collecting debris drawn into said well from said pool, said sealed upper surface of said skimmer well being located below the water level of said pool, said combination including:

an underwater suction-powered pool cleaner (PC having a water suction hose (H) connected through the well cover plate (22) to said skimmer well (18) for depositing debris from the floor of said pool into said perforated basket (26);

a skimmer flow orifice (22*a*) formed in the well cover plate (22) for receiving debris drawn into said skimmer system from the surface of said pool for deposits into said perforated basket; and an automatic flow shift valve (30) having a lower valve mounting plate (32) including a circular valve flow orifice (34) having a downwardly and inwardly sloped annular conical surface positioned on the well cover plate in interfacing relationship to said skimmer flow orifice of said well cover plate, said flow shift valve comprising:

a) a central shift cylinder (40) having an upper end portion and a lower end portion and mounted in a fixed position above said valve mounting plate (32) and in axial alignment with said circular valve flow orifice (34);

b) a movable circular valve closure plate (36) having a downwardly and inwardly sloped annular conical surface for interfacing with the annular conical surface of said valve flow orifice for periodically closing and opening said valve flow orifice of said valve mounting plate (32);

c) a first elongated valve control piston (50) having its lower end interconnected to said valve closure plate (36) and its upper end extending upwardly therefrom and into reciprocating relationship within the lower end portion of said shift cylinder (40);

d) a valve top plate (64) interconnected in fixed relationship to the circular valve closure plate (36), said top plate being located above the upper end portion of said shift cylinder (40) and being movable with said closure plate;

e) a second elongated valve control piston (66) having its upper end interconnected to said valve top plate (64) and its lower end extending downwardly therefrom and into reciprocating relationship within the upper end portion of said shift cylinder (40), the upper end of said said first piston (50) and the lower end of said second piston (66) being spaced from one-another and defining a valve control space within said shift cylinder (40) between said pistons;

f) biasing means (68) located between said top plate (64) and the upper end portion of said shift cylinder (40) for urging said top plate and the interconnected valve closure plate (36) upwardly into an upper open valve position when said suction pump is at rest and no water suction force is applied to the underside of said closure plate to pull it toward said valve flow orifice (34) in opposition to said biasing means (68), the upward movement of said valve closure plate (36) being limited by the interface contact of said closure plate with the lower end portion of said shift cylinder;

g) a cam (60) and first stop means (40*b*) within the central shift cylinder (40) for limiting the downward reciprocation of the second valve control piston (66) to an intermediate open valve position during operation of said suction pump with the application of water suction force to the underside of the valve closure plate (36) in opposition to said biasing means (68) whereby the water suction force of said pump draws water and surface debris through the skimmer and valve flow orifice (34) into said debris basket (26); and h) second stop means (40*a*) for said cam (60) within the central shift cylinder (40) for limiting the downward reciprocation of the second valve control piston (66) to a bottom closed position during operation of said suction pump with the application of water suction force to the underside of said valve closure plate (36) in opposition to said biasing means (68) whereby said closure plate (36) closes said valve flow orifice (34) and the water suction force of said pump draws water and pool floor debris from said underwater pool cleaner into said debris basket.

7. An automatic flow shift valve as claimed in claim 6 wherein the biasing means located between the valve top plate and the upper end of the central shift cylinder is a coil spring which surrounds the second control valve piston interconnected to said top plate.

8. An automatic flow shift valve as claimed in claim 6 wherein the central shift cylinder of said valve mounted in a fixed position above the valve mounting plate includes radially extending mounting flanges each supported on a mounting post which extends upwardly from said mounting plate.

9. An automatic flow shift valve as claimed in claim 6 wherein the top plate of said valve is interconnected in fixed relationship to the valve closure plate by annularly spaced mounting posts positioned outside of the central shift cylinder, said mounting posts being adjustable in their length to provide appropriate spaced-apart positioning of the first and second valve control pistons within said shift cylinder to form the valve control space within said shift cylinder.

10. An automatic flow shift valve as claimed in claim 9 wherein the cam within the central shift cylinder is of wedge shape with two opposing cam-head catch projections and is movable upwardly and downwardly in an oval shaped cam channel wherein the first stop means within said shift cylinder and comprises an upper catch ledge on one side of said cam channel for interacting with the cam-head catch projection on one side of said cam to lock the second valve control piston of said valve in its open valve position and the second stop means within said shift cylinder comprises an intermediate catch ledge on the opposite side of said cam channel for interacting with the cam-head catch projection on the opposite side of said cam to permit the second valve control piston of said valve to assume its valve closed position.

11. An automatic flow shift valve as claimed in claim 6 wherein the valve flow orifice of the lower valve mounting plate has a cortically shaped orifice surface and the movable valve closure plate has a matching cortically shaped rim surface for closing said valve when said surfaces are interfaced.

* * * * *